United States Patent [19]

McClung

[11] 4,432,437

[45] Feb. 21, 1984

[54] FIRE ESCAPE SYSTEM

[76] Inventor: Thomas E. McClung, Old Forge Village, Clifton Forge, Va. 24422

[21] Appl. No.: 270,852

[22] Filed: Jun. 10, 1981

[51] Int. Cl.[3] ..... A62B 1/10

[52] U.S. Cl. ..... 182/234; 182/236

[58] Field of Search ..... 182/231, 232, 233, 234, 182/235, 73, 74, 75, 236, 237, 238, 239, 240, 3

[56] References Cited

U.S. PATENT DOCUMENTS

| | | | |
|---|---|---|---|
| 285,197 | 9/1883 | Yount | 182/239 |
| 285,319 | 9/1883 | Stofflet | 182/239 |
| 531,883 | 1/1895 | Vieregg | 182/239 |
| 730,839 | 6/1905 | Peterson | 182/237 |
| 779,284 | 1/1905 | Johnson | 182/239 |
| 990,029 | 4/1911 | Borden | 182/239 |
| 2,933,157 | 4/1960 | Huber | 188/65 |
| 2,976,955 | 3/1961 | Huber | 188/65 |
| 3,419,236 | 12/1968 | Weber | 188/65 |
| 3,519,248 | 7/1970 | Kushiro | 254/377 |
| 3,834,671 | 9/1974 | Du Mesnil du Buisson | 254/377 |
| 3,847,377 | 11/1974 | Byrd | 254/377 |
| 3,879,016 | 4/1975 | Kankkunen | 254/377 |
| 3,907,256 | 9/1975 | Kankkunen | 254/377 |
| 4,093,186 | 6/1978 | Golden | 188/65 |
| 4,173,332 | 11/1979 | Du Londel | 254/377 |

*Primary Examiner*—Reinaldo P. Machado

*Attorney, Agent, or Firm*—W. Allen Marcontell

[57] ABSTRACT

A controlled descent-speed, line system is described for the emergency evacuation of high office buildings, apartments and hotels. Included is a small diameter, high-strength steel cable of sufficient length wound upon a flanged reel. One reel flange is hobbed for drive chain teeth to drive a centrifugal clutch rotor hub sprocket. The out-drive clutch drum torques a linear actuator shaft which applies direct braking force to the cable reel. The load end of the cable is provided with a harness and umbrella deployable shield. The shield is stored as a slender, elongated column. Upon use, weight of the user collapses a number of straight spring strips into respective bows to approximate a spherical ball connected in the cable line above the users head to deflect heavy, falling debris and to maintain clearance between the face of the evacuated building and the user.

19 Claims, 9 Drawing Figures

FIRE ESCAPE SYSTEM

BACKGROUND OF THE INVENTION

1. Field Of The Invention

The present invention relates to speed limited lowering devices for removing fragile weights from significant heights. More particularly, the present invention relates to cable and harness fire escape devices for the emergency evacuation of persons from high buildings and structures.

2. Description Of The Prior Art

The architectural and construction advent of high buildings of 15 or more stories has created the need for emergency escape systems other than exterior stairways. Even the longest of powered extension ladders extend to only about 100 feet. The height of a 15 story building is in the order of 175 feet.

Controlled descent line systems have been proposed in the past but not widely adopted. Reasons for such rejection primarily relate to characteristics unique to the specific descent control system proposed but generally fall in two categories. Some prior art systems require that the descent be controlled by the user with some physical manipulation. This, of course, requires that the user be alert and physically capable: circumstances not appropriate to the very young, the elderly or unconscious victims of smoke and gas inhalation.

Other prior art controlled descent line systems are provided with a stored line reel having means to limit the reel rotational speed as line is drawn off by the user's weight. In these systems, the user rides passively in a harness secured to the lower end of the line. Although most attractive from the perspective of eliminating the need for user consciousness, strength or agility, most such prior art speed limiting reels have tended to rely on fluid energy dissipation as the reel retarding mechanism. However, like any other emergency use systems, building descent devices must be stored for long periods of time with minimal test and maintenance attention. Fluid seals deteriorate and flow restricting orifices become blocked with deposits. In other cases, polished, machine sliding surfaces seize from rust or atmospheric dust.

U.S. Pat. No. 2,976,955 to J. R. Huber discloses a hybrid type of system wherein the user hangs from a wrist sling attached to a small, centrifugal clutch retarded line speed control device driven by a threaded or helical groove sheave around which a hanging, high friction rope line is wrapped. Although a harness or other body supporting device may be substituted for the wrist sling of Huber, some tension must be maintained on the lower end of the rescue line to preclude slippage over the helical groove drive sheave. This requires consciousness and understanding by the user of the operating principle of the device. Moreover, operation of the Huber device is predicated on the high surface friction characteristics of rope, which is not only bulky for the quantities required of high buildings, but is also flammable.

Another possible inhibition to reliance on controlled descent line systems for emergency evacuation of high buildings is the lack of protection the user has from falling debris. When such buildings burn, large sheets of glass are pushed out of their mountings, sometimes intact, by the hot gas pressures generated inside the building. Additionally, heat escaping from window openings burns away the mortar securing stone sills and parapets. Victims of hotel fires throw out possessions and luggage. All of this falling debris descends to the ground in the same approximate zone as the user of a controlled descent line system. If not protected from such debris during his descent interim, the user has a high probability of receiving serious or even fatal injuries therefrom.

It is, therefore, an object of the present invention to teach the design of an emergency, controlled descent line system having no critically machined working surfaces Another object of the invention is to teach a descent line reel speed control mechanism having no fluid to leak, seals to fail or orifices to plug.

Another object of the invention is to teach a cascaded sliding friction system for regulating the rotational payout rate of a line storage reel.

Another object of the invention is to teach a mechanical feedback system for regulating the payout rate of a line storage reel.

Another object of the invention is to teach a two-stage speed control system which permits a relatively rapid descent rate until reaching a distance of approximately 10 feet above the ground whereupon the system automatically, with no action by the user, shifts to a slower descent speed for ground approach.

Another object of the invention is to teach an automatically deployable canopy device for protecting an emergency descent line user from falling debris.

BRIEF DESCRIPTION OF THE INVENTION

These and other objects of the invention are accomplished by means of a descent control mechanism having a line storage reel with a disc brake flange and a drive chain sprocket. Driven by the reel sprocket is a rotor hub portion of a centrifugally engaged shoe clutch. The drum portion of the centrifugal clutch is linked for limited arcuate movement of a disc brake actuator. The disc brake actuator acts upon the reel flange to retard rotation of the same element that energizes the retarding system. For this reason, the present descent control mechanism may be analyzed as a true feedback speed regulation system. Moreover, since there are two energy absorbing devices in series with the feedback loop, a degree of cascaded system redundancy enhances system reliability and safety.

At the load connected end of the descent line is a load expansible umbrella shield to deflect falling debris from a descent system user. An additional objective served by the shield includes a non-snagging device for maintaining a discreet separation distance between the user and the building face. Another shield objective is as a means to release the load supporting end of the descent line in the event of snagging upon rewinding for a subsequent use. To accomplish these and other objectives, the reeled end of the descent line and a user harness attached end are linked by a pair of coaxially collapsing telescope tubes. Between opposite ends of the expanded telescope assembly are hinged respective ends of straight, thin, spring steel strips. As the descent line accepts the weight of the system user, the straight spring strips collapse outward under column loading to permit coaxial closure of the expanded telescope tubes thereby drawing the opposite hinged ends of the spring strips toward each other thereby further bowing the strip lengths laterally outward. Such laterally bowed spring strips provide adequate structure to receive the impact and deflect heavy falling objects from striking the user. Such deflection also includes deflection of the user as a free pendulum from the path of an extremely heavy object.

BRIEF DESCRIPTION OF THE DRAWING

Relative to the drawing, like reference characters are used throughout the several figures of the drawing to designate like or similar elements.

DETAILED DESCRIPTION OF THE PREFERRED EMBODIMENTS

Figure 1:
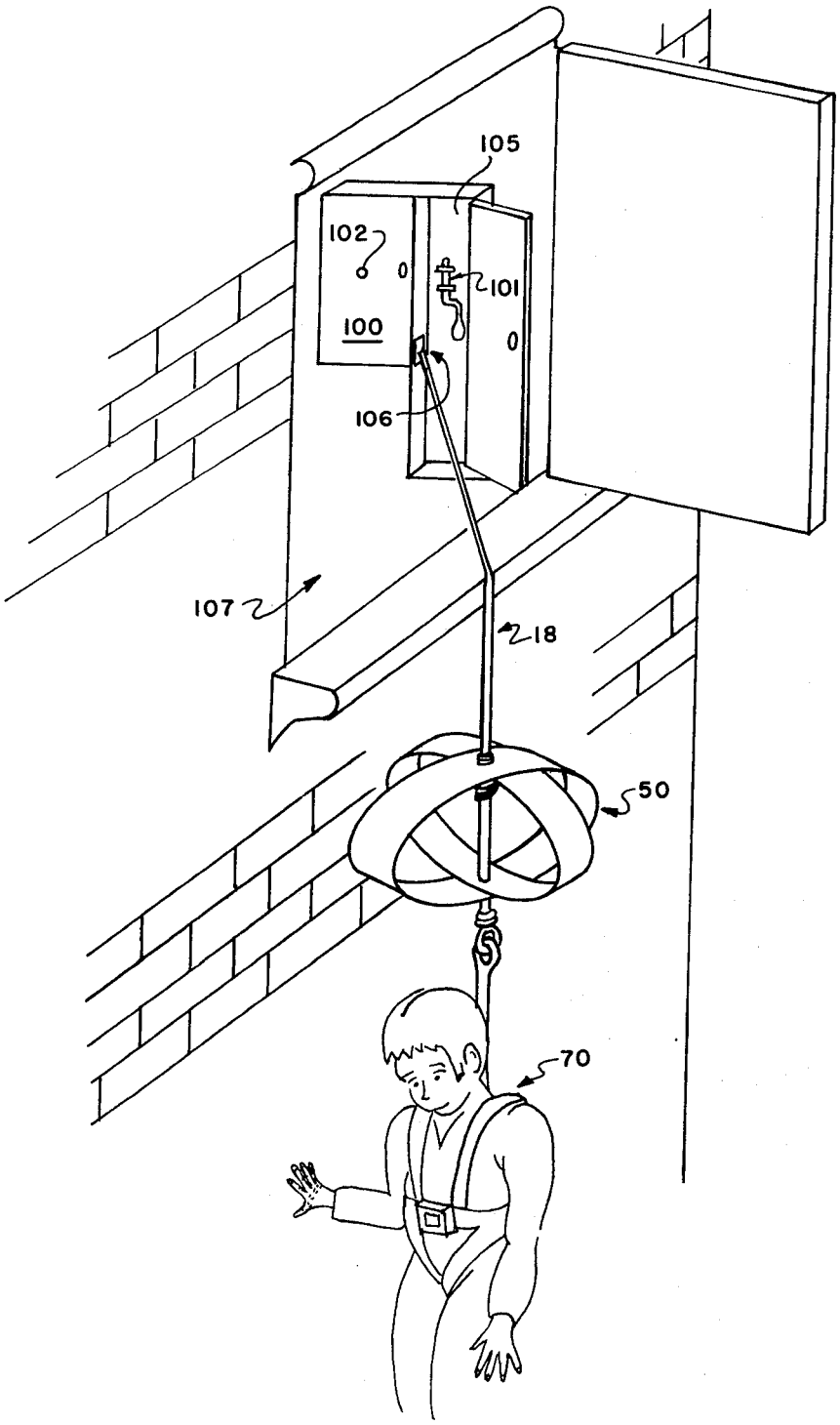
FIG. 1 is a pictorial view of the invention in use.
Figure 3:
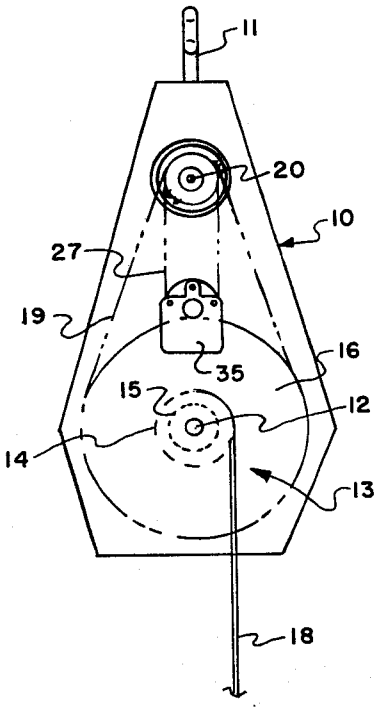
FIG. 3 is a sectional side view of the present descent control mechanism.
Figure 2:
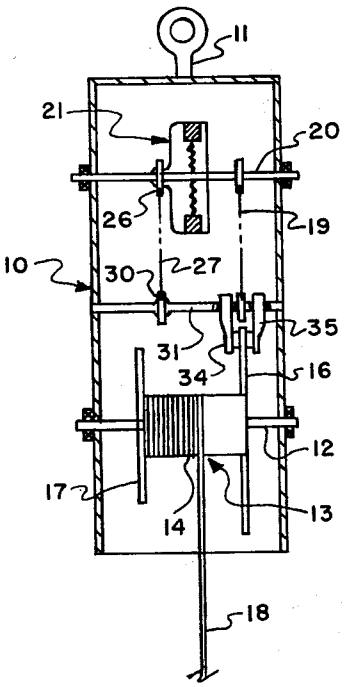
FIG. 2 is a sectional end view of the present descent control mechanism.

Relative to FIGS. 2 and 3 simultaneously, the descent control mechanism of the invention comprises a housing structure 10 of adequate structural integrity to safely support the loads imposed. A mounting eye 11 is shown but it should be understood that other anchoring techniques may be more appropriate to a given application. For example, hotels and high office buildings may prefer direct attachment to a wall or, as illustrated by FIG. 1, even recessed therein beside a proximate window opening thereby eliminating the need for a frantic user to find suitable anchorage in the moment of his emergency.

Bearing mounted to opposite faces of the housing 10 are axle shafts 12 and 20. Shaft 12 supports a two stage reel 13 having two cable drum surfaces 14 and 15. Drum surface 14 is of greater diameter than surface 15 to provide more cable length payout per revolution than from surface 15.

Axially flanking the drum surfaces are reel flanges 16 and 17 for confining the cable 18 on the drum surfaces. Additionally, the peripherial rim of flange 16 is hobbed with chain teeth for driving chain 19. Another characteristic of flange 16 is that it be of suitable material and surface finish to serve as a disc brake flange.

Figure 5:
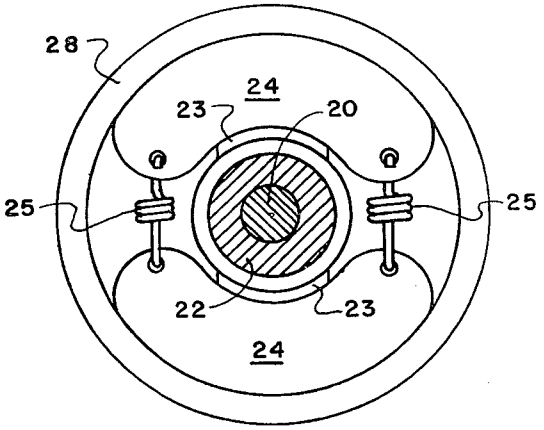
FIG. 5 is an axial end-section view of the centrifugal clutch.
Figure 4:
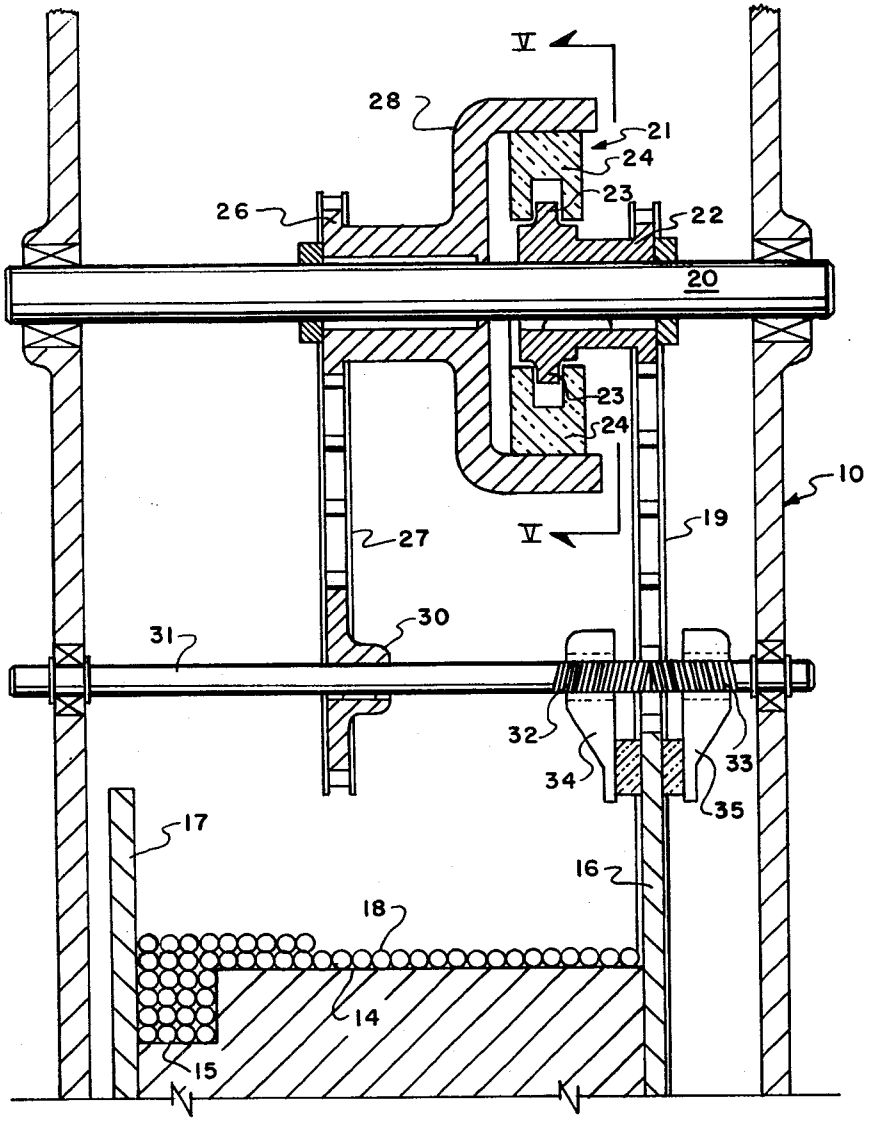
FIG. 4 is an enlarged sectional view of the clutch and brake mechanism.

Axle shaft 20 supports a centrifugal clutch assembly 21 shown in greater detail by FIGS. 4 and 5. Within the assembly 21 is included a chain toothed rotor hub 22 non-rotatively keyed to the axle shaft 20. Also integral with the rotor hub 22 unit are a pair of radially projecting ears 23 for transmitting brake forces from the hub 22 to respective clutch shoes 24. Centripetal springs 25 bias the shoes 24 radially inward against centrifugal forces. When centrifugally expanded, shoes 24 engage the inside surface of clutch drum 28 which is bearing mounted for rotation about, but independently of, axle shaft 20. Integral with the clutch drum 28 is an outdrive chain sprocket 26 carrying brake chain 27.

The particular clutch assembly 21 described herein is a 350 Series "Self-Contained" clutch available from Comet Industries, 358 N. W. F St., Richmond, Ind. and is distinctive for its low rotational speed engagement. Equipped with low tension springs 24, this particular clutch will reliably and uniformly engage at 500 r.p.m.

Brake chain 27 engages the teeth of sprocket hub 30 which is non-rotatively keyed to brake actuator shaft 31. The actuator shaft 31 is also bearing mounted to the housing 10 face plates and is turned with opposite hand thread leads 32 and 33 for receiving brake pads 34 and 35 disposed for opposite face engagement of flange 16.

The cable 18 may be an extremely small diameter, ⅛ inch for example, high tensile strength aircraft control cable having a maximum tensile capacity in the order of 1,000 pounds. Using such small diameter cable, a 2 inch diameter drum surface 14 will hold 98 feet of cable per axial length when laid to a depth of 2 inches. Slow speed drum surface 15 receives only approximately 10 feet of cable length for the final approach to the ground and for such reason need be only ½ inch of axial length for a 1 inch diameter.

For a 6 feet per second fast descent rate, the 2 inch drum surface 14 with cable laid 2 inches deep will turn approximately 240 r.p.m. A 9:1 drive ratio between the flange sprocket 16 and the centrifugal clutch rotor hub sprocket 22 will provide a 2160 r.p.m. rotational speed for the hub and clutch shoes 24 whereupon sliding frictional force begins transmission to the drum 28 and sprocket 26. Full circle rotation of the drum 28 and sprocket 26 are not intended: a partial circle drive via the chain 27 and brake actuator sprocket 30 for partial rotation of the actuator shaft 31 turns the opposite hand thread leads 32 and 33 to oppositely advance the torque restrained brake pads 34 and 35 compressively against the opposite faces of reel flange 16.

Analysis of this feedback circuit rotational speed control system will show that an equilibrium speed is attained whereat the clutch friction forces transmitted from the clutch shoes 24 to the drum 28 approximately equal the drag forces imposed by the brake pads 34 and 35 on flange 16, said flange being the same element which drives the system.

Dependent on the spring rate of centripetal springs 25, the proportion of total dissipated energy may be selectively apportioned between the clutch 21 and the brakes 34 and 35. By spring loading the actuator shaft 31 in a rotational direction opposite from that required for brake application, energy may be dissipated by the clutch without application of the brake. Clutch drum 28 torque is resisted by the actuator shaft 31 spring (not shown). A heavier descent load requiring greater energy dissipation would drive the clutch faster against the friction energy dissipation between the shoes 24 and drum 28 to increase the torque transmitted by the drum to the actuator shaft 31. Such increased torque transmission would overcome the bias of the actuator retarding spring thereby permitting brake engagement with the flange 16. Any desired apportionment of the dissipated energy may be attained by discreetly proportionalizing the centripetal springs 25 to reactive bias of actuator 31.

Figure 9:
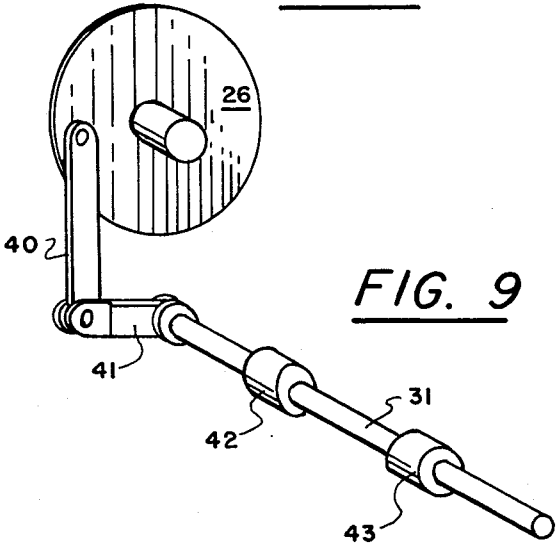
FIG. 9 is an isometric schematic of an alternative brake actuation mechanism.

It will also be noted by those skilled in the art that a brake actuating system such as that represented by FIG. 9 may be substituted for the chain 27 and sprocket 30. The FIG. 9 system basically comprises a toggle link 40 pivotally connected at one end thereof to an out-drive flange 26 integral with the clutch drum 28. The other end of the toggle link 40 is pivotally connected to a crank-arm 41 which is non-rotatively secured to the actuator shaft 31. Instead of thread leads to compress the brake pads (not shown), end-face profiled cylinder cams 42 and 43 perform the compression function.

Either brake actuation system, chain and thread or toggle link and cam, is adapted to numerous permutations.

Notable also from the present speed regulation system is the inherent safety consequence should the flange 16 brake system fail. The clutch drum 28 is still restrained from rotation and has the capacity to absorb all the descent energy. Although the descent speed will be greater in this event due to the greater centrifugal forces required of the clutch shoes 24, fatal descent speeds are averted. Such operational system functional duplication is characterized as cascaded redundancy.

Figure 7:
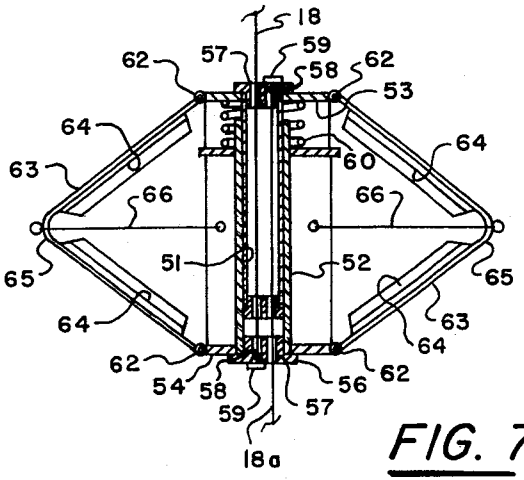
FIG. 7 is a sectional side view of the collapsed umbrella shield.
Figure 8:
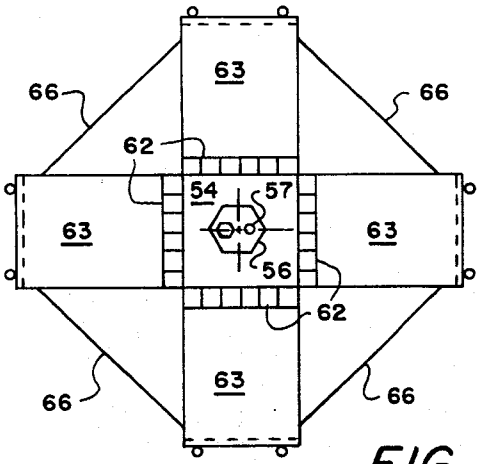
FIG. 8 is an end view of the collapsed umbrella shield.
Figure 6:
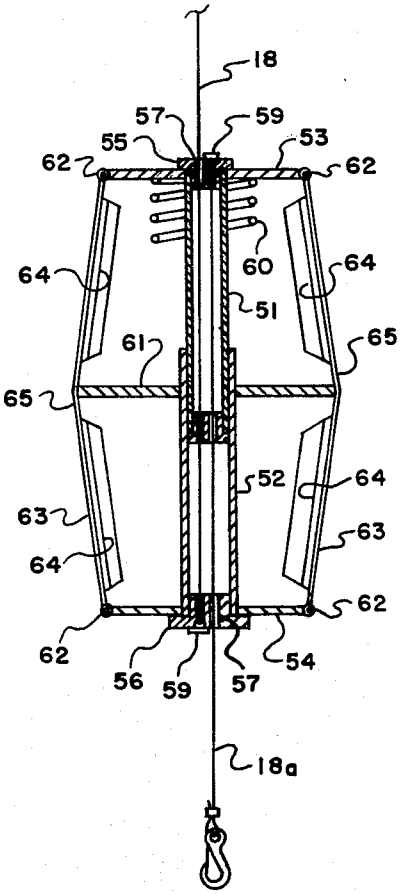
FIG. 6 is a sectional side view of the elongated umbrella shield.

Focusing now on the safety umbrella 50 of FIGS. 6, 7 and 8, two telescoping tubes 51 and 52 are coaxially disposed. At each end of the telescope assembly are respective plates 53 and 54, approximately 4 inches square. End nuts 55 and 56 thread internally into respective tubes 51 and 52. Both of the end nuts 55 and 56 are provided with two apertures 57 and 58. Apertures 57 receive respective cables 18 and 18*a* slidably therethrough. Apertures 58 receive a threaded swage nut 59 to anchor the respective cables.

Below the upper plate 53 is a shock absorbing spring 60. A corresponding spring plate 61 is secured to the lower tube 52.

Along the four edges of the end plates 53 and 54 are hinges 62 by which shield strips 63 are pivotally attached at both ends thereof. Such shield strips 63 are preferably fabricated of thin, 0.062 inch thickness high carbon, spring steel. Note should be taken that the radial dimension of spring plate 61 is greater than that of end plates 53 and 54 for the design objective of maintaining a slight bow in the length of strips 63.

To each strip 63 are riveted two longitudinal angle section stiffeners 64 along the top and bottom halves of the strip. A hinge section 65 of the strip 63 mid-length is left free of stiffening structure.

Length dimensions of the tubes 51 and 52 and shield strips 63 are selected to provide an approximate 24 inch diameter umbrella profile when deployed as illustrated by FIG. 7.

In the unloaded or stored condition shown by FIG. 6, the internal spring properties of the shield strips 63 keep the telescoping elements 51 and 52 expanded. However, the periphery of spring plate 61 prevents the strips 63 from reaching a straight, rigid column position. When cables 18 and 18*a* sustain significant tensile load, 15 to 20 pounds for example, the shield strips 63 buckle at the hinge section 65 thereby permitting the telescoping tubes 51 and 52 to coaxially collapse. Such collapse closes the distance between end plates 53 and 54 thereby forcing the lateral spreading of the shield strips 63. Since the weight of an adult user of the descent system will greatly exceed the collapsing load of the strips 63, spring 60 will attenuate the shock due to such collapse, which is sudden.

Additional structure such as steel cable braces 66 may be added between adjacent longitudinal edges of respective strips 63 to add twist rigidity to the strips 63 and an additional measure of protection to the user.

More elaborate means may also be added to the umbrella 50 but the structure described is sufficient to deflect large sheets of glass, timbers and the like falling in the same zone as the descending user. While more complete protection of the user is statistically desirable, such additional protection also adds weight and opportunity to snag on ledges and parapets. Moreover, upon rewinding for a second and subsequent user's descent, the basic structure will be found to be self-releasing from ledge snags by the end plates 53 and 54. By winding additional tension into the cable 18, the shield strips 63 may be remotely deployed to push the umbrella free of such snags.

Relative now to the pictorial of FIG. 1, the descent control mechanism of the invention is recess mounted in the wall of a high building behind a locked cabinet door 100. Since there is no need for the user to have any direct contact with this mechanism aside from rewinding the cables 18 for subsequent uses, the safe integrity of the device is best maintained by such restricted access. Rewinding may be accomplished by means of an accessible hand crank 101 inserted through a properly aligned aperture 102 in locked door 100. When inserted through the aperture 102, the crank shaft engages the reel axle shaft 12.

Alongside the locked cabinet 100 is an unlocked cabinet 105. The unlocked cabinet stores the elongated umbrella 50 and harness 70 in an assembled, ready to use condition. An aperture 106 connects the two cabinet interiors and through which is threaded the cable 18.

Each installation of the invention system will have a fixed distance from the aperture 106 to the ground. Such fixed distance length of cable 18 is provided; the first 10 feet of same being wound onto the slow speed drum surface 15 by the installer.

When use is required, the user merely removes the cable 18 connected shield 50 and harness 70 from the cabinet 105 and dons the harness. Upon lowering himself out a convenient open window 107, the user will experience a short, 3 to 4 feet, rapid fall until the clutch 21 and flange brake stabilize the reel 13 rotational speed whereupon the cable accepts the user's weight load. Such weight load automatically deploys the shield 50 to maintain the user at a safe distance from the building face and protect him from falling debris. Thereafter, descent will continue at a rapid but safe speed until the final 10 feet of cable is reached whereupon the descent speed will slow to a more comfortable ground contacting speed.

The first user, having doffed the harness 70, signals anyone remaining in the room to retract the harness by inserting the handcrank 101 through the locked cabinet aperture 102 and rotating. This procedure may be repeated as many times as necessary.

Since no activity or manual dexterity from the user is required, the invention may be used to evacuate the invalid as well as the unconscious.

Having fully described my invention, those of ordinary skill in the art will note the opportunity for special case alternatives and obvious mechanical equivalents. As my invention, however,

I claim:

1. An emergency evacuation system for occupants of high structures comprising:

A. Rotational speed controlled reel means for releasing a weight sustaining line at a substantially constant velocity;

B. Weight confining harness means connected to the leading end of said line; and C. Weight deployed shield means for deflecting falling debris from striking said weight.

2. An evacuation system as described by claim 1 wherein said reel means comprises a feed-back frictional loop for governing the rotational speed of said reel means.

3. An evacuation system as described by claim 1 wherein rotation of said reel means drives centrifugally engaged clutch means, said clutch means being operatively connected to brake actuation means, said brake means engaging said reel means to retard same upon engagement of said clutch means.

4. An evacuation system as described by claim 1 wherein said shield means comprises a plurality of weight bowed spring strips which extend laterally from an axis of said line when stressed by the load of said weight.

5. A rotational speed governed weight descent apparatus for governing the descent rate of a line supported weight, said apparatus comprising:

A. Rotating reel means for storing said line as wound thereabout;

B. Centrifugal clutch means driven by line pay-out induced rotation of said reel means to rotatively torque a rotatable outdrive means;

C. Brake means for retarding the rotational speed of said reel means;

and,

D. Actuator means for linking said outdrive means to the engagement of said brake means.

6. An apparatus as described by claim 5 wherein said reel means is provided with flange means having chain sprocket teeth about the rim thereof and adapted to cooperate with said brake means.

7. An apparatus as described by claim 6 wherein said flange sprocket teeth are linked by drive chain means to sprocket means for driving said centrifugal clutch means.

8. An apparatus as described by claim 5 wherein said centrifugal clutch means comprises rotor hub means for expanding centripetally biased shoe means and said outdrive means comprises independently rotatable drum means for receiving torque forces transmitted by said expanding shoe means.

9. An apparatus as described by claim 8 wherein said outdrive drum means is restrained from full rotation by said brake actuator means.

10. An apparatus as described by claim 5 wherein said brake means comprises shoe pads for engaging respectively opposite faces of a flange means that is rotatively driven by said reel means.

11. An apparatus as described by claim 10 wherein said shoe pads are oppositely translated against said opposite faces by partial rotation of an actuator shaft, said partial rotation being driven by said outdrive drum means.

12. An apparatus as described by claim 5 wherein said actuator means comprises a threaded shaft having opposite-hand thread leads.

13. An apparatus as described by claim 5 wherein said actuator means comprises profiled face cylinder cams.

14. An apparatus as described by claim 5 wherein said reel means has line drum surfaces respective to at least two cylinder diameters.

15. A deployable protective shield for deflecting falling debris from striking a line supported weight, said shield comprising:

A. Telescoping means having an upper tube coaxially disposed with a lower tube;

B. An upper portion of a weight supporting line secured to said lower tube;

C. A lower portion of said weight supporting line secured to said upper tube; and, D. A plurality of straight spring strips pivotally connected at opposite ends thereof to said telescoping means, one end connected to said upper tube and the other end connected to said lower tube whereby imposition of said weight on said line draws said tubes coaxially together against the bowing bias of said strips.

16. A deployable shield as described by claim 15 wherein said strip ends are hinged to said tubes for restricting said bowing to a radial direction from the axis of said telescoping means.

17. A deployable shield as described by claim 15 comprising an abutment means around the approximate mid-length of said telescoping means for maintaining a slight bow in said strips without imposition of said weight.

18. A deployable shield as described by claim 15 comprising means for independently stiffening the upper portion of said strips.

19. A deployable shield as described by claim 15 wherein said strips bow at the mid-portion thereof and stiffening structure is secured to said strips between said strip mid-portion and said pivotally connected ends.

* * * * *